United States Patent [19]

Verneker

[11] Patent Number: 4,824,495

[45] Date of Patent: Apr. 25, 1989

[54] COMBUSTIBLE COATINGS AS PROTECTIVE DELAY BARRIERS

[75] Inventor: Vencatesh R. P. Verneker, Jessup, Md.

[73] Assignee: Martin Marietta Corporation, Bethesda, Md.

[21] Appl. No.: 36,660

[22] Filed: Apr. 10, 1987

[51] Int. Cl.[4] ..... C06B 45/34

[52] U.S. Cl. ..... 149/7; 149/2; 149/15; 149/42; 149/43; 149/44; 109/23; 109/29; 109/36; 102/293

[58] Field of Search ..... 109/23, 36, 29; 149/2, 149/7, 15, 42, 43, 44; 102/293

[56] References Cited

U.S. PATENT DOCUMENTS

| | | | |
|---|---|---|---|
| 888,052 | 5/1908 | Vaughn et al. | 109/37 X |
| 1,805,610 | 11/1928 | Young | 89/36.17 |
| 2,012,453 | 3/1930 | Lowy et al. | 89/36.17 |
| 3,266,959 | 8/1966 | Ackley | 149/19.4 |
| 3,309,249 | 3/1967 | Allen | 149/2 |
| 3,638,573 | 2/1972 | Campbell | 149/15 |
| 3,697,668 | 10/1972 | Campbell | 109/36 |
| 3,740,277 | 6/1973 | Poulin et al. | 149/15 |
| 3,802,970 | 4/1974 | Bishop et al. | 149/2 |
| 3,882,324 | 5/1975 | Smolker et al. | 109/36 |
| 3,889,601 | 6/1975 | Koehne et al. | 109/36 |
| 4,115,999 | 9/1978 | Diebold | 149/44 |
| 4,246,051 | 1/1981 | Garner et al. | 149/7 |
| 4,411,717 | 10/1988 | Anderson | 149/19.4 |

*Primary Examiner*—Stephen J. Lechert, Jr.
*Attorney, Agent, or Firm*—Herbert W. Mylius; Gay Chin

[57] ABSTRACT

A combustible coating for providing a delay barrier to intrusion into an object. The coating contains a source of fuel as a metal and/or a polymer and a source of oxygen such as an oxidizer. The coating is ignitable at a temperature in excess of about 300° C., during combustion is resistant to the effects of common fire extinguishing materials, and is capable of sustaining combustion for at least five minutes with a burn rate of no more than about six inches per minute.

23 Claims, 1 Drawing Sheet

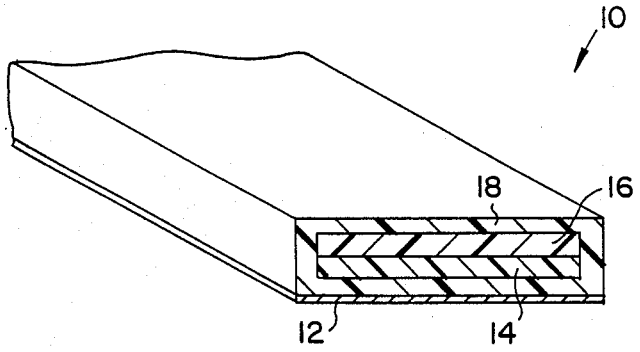
10
18
16
12
14

COMBUSTIBLE COATINGS AS PROTECTIVE DELAY BARRIERS

The present invention relates generally to security measures for unattended objects such as structures, installations, buildings, equipment, vehicles, vaults, and the like and, more particularly, the invention relates to security measures in the form of combustible coatings which ignite upon intrusion and thus delay unauthorized entry or penetration of the object until appropriate authorities are alerted and are able to respond.

BACKGROUND OF THE INVENTION

Many objects, such as defined above, contain items of significant value and/or of a sensitive or proprietary nature such as to be inviting targets for intrusion by thieves, terrorists, spies and the like. In all too many instances, conventional security equipment to help prevent these intrusions is ineffective, too dangerous for normal use around authorized personnel, and/or is too expensive for the degree of security provided. Also, the use of armed guards or security personnel is very expensive, and in some instances, may be unreliable in the face of an intense attempted intrusion.

It has been previously proposed that certain types of combustible materials could be used as delay barriers in helping to prevent unauthorized entry into various objects. For example, U.S. Pat. No. 888,052 to Vaughn et al. discloses a burglarproof jacket for a safe or vault having inner and outer casings, with a coating of plaster containing an ignitable material such as match heads, as well as explosive material, between the casings. While this construction for a safe may be an effective deterrent to an intruder, the explosive nature of some of the materials renders the safe hazardous in the normal workplace and poses a real risk of destruction of the contents of the safe. Furthermore, since combustion is so rapid, an intruder could simply wait until combustion has ceased and then gain entry to the object.

Also, U.S. Pat. Nos. 1,805,610 and 2,012,453, to Young and Lowy et al., respectively, disclose vault and safe constructions which include a gas producing combustible material to help prevent entry into the safe when the safe wall is cut with a torch or the like. The gas produced by the combustible material is intended to be physically incapacitating to the user of the torch. The clear disadvantage of these safe constructions is that the incapacitating effect of the generated gas can be easily circumvented by the use of a gas mask or other gas protection equipment. Also, the combustion is not self-sustaining and it is possible to quench the combustion with conventional fire extinguishing materials such as water.

SUMMARY OF THE INVENTION

It is therefore a feature of the present invention to provide a combustible coating for use as a delay barrier in preventing unathorized entry into an object.

It is another feature of the invention to provide combustible coatings for an object which give the object a high degree of security.

Another feature of the combustible coatings of the subject invention is that the coatings are relatively safe against accidental ignition.

Yet a further feature of the combustible coatings according to the present invention is that the coatings are made of readily available and inexpensive materials, and are relatively light in weight.

Yet another feature of the combustible coatings of the invention is that they are non-explosive and thus can be transported and used relatively safely.

Another feature of the combustible coatings of the invention is that the coatings upon ignition need not, but can, destroy the object to which the coating is associated.

Briefly, the present invention in its broader aspects comprehends a combustible coating or barrier for providing a delay barrier to an intrusion into an object, the coating containing a source of fuel and a source of oxygen, the coating being ignitable at a temperature in excess of about 300° C. During combustion, the coating is resistant to common fire extinguishing materials and is capable of sustaining combustion for an extended time period with a burn rate of no more than about six inches per minute. The preferred coating compositon is a three component coating comprising an oxidizer, a fuel metal, and a binder.

Further objects, advantages, and features of the present invention will become more fully apparent from a detailed consideration of the following description taken together with the accompanying drawing.

BRIEF DESCRIPTION OF THE DRAWING

In the drawing, the sole figure is a perspective view, partially in section, of a substrate bearing a preferred combustible coating according to the invention.

DETAILED DECRIPTION OF THE PREFERRED EMBODIMENTS

The coating compositions according to the present invention may comprise a wide variety of constituents in widely varying proportions. The constituents and their proportions for the compositions must, however, be selected such that three important criteria for compositions are met; that is, the compositions must ignite at a relatively high temperature, the compositions are non-explosive, and the compositions must burn relatively slowly for a long period of time, and be resistant to quenching or extinction.

More specifically as to the first criteria, a relatively high ignition point for the combustible coating is necessary to prevent accidental ignition by low energy contact with the coating. This enables authorized persons to use the object for its intended purpose without fear of injury or damage to the object. Generally, the ignition temperature of the coating for safety purposes should be in excess of about 300° C., and preferably in excess of about 400° C. With such an ignition temperature, the combustible coating will not ignite upon penetration by a bullet or other high velocity component, but will ignite under the thermal heat generated by a power saw, an explosive charge, or the like.

As to the second criteria, the basic consideration is that the coating burn for a long enough period of time near the point of intrusion such that an intruder would be held at bay until appropriate authorities arrive and secure the object. As is evident, the exact time period of combustion for a particular coating may be varied according to the type of object coated by the composition and its location relative to personnel capable of responding to an attempted unauthorized entry. In some situations, a combustion period of as little as five minutes may be sufficient whereas in other situations, combustion periods of up to one hour or more may be necessary. In the same view, the combustion should also be relatively slow such that explosive combustion cannot occur which would most likely damage or even destroy the object being protected, or surrounding structures or areas of buildings. Further, if the coating was of an explosive nature, transportation, installation and handling of the combustible coating would be quite hazardous and subject to special rules and regulations, and perhaps even prohibited on the grounds of safety. Thus the coating should be capable of rapid, yet non-explosive combustion, that is, the coating should be of an incendiary or pyrotechnic material.

In another manner of viewing this criteria, the coating composition should have a so-called "burn rate," i.e., the linear amount of coating combusted or burned per unit of time, which is balanced between a rapid rate, which could consume the coating in a short period of time or even explosively, and thus render the coating essentially ineffective, and a relatively slow rate which would not provide a sufficiently delaying barrier for an intruder. In general terms, it has been found that a burn rate of at least about one half inch per minute to about six inches per minute, and preferably of at least about one inch per minute up to about three to four inches per minute, is satisfactory for most purposes. A burn rate greatly in excess of these rates, e.g., above twenty inches per minute, will not provide effective delay protection as the coating would be consumed too quickly in the area of the intrusion. In accordance with the invention, apparopriate selection of the constituents of the combustible coatings and their relative amounts can be made so as to achieve the desired burn rate for an effective delay barrier.

The third criteria is that the combustion of the coating be substantially uneffected by. conventional fire extinguishing materials such as water, carbon dioxide, foam, and the like. Such a capability is of course necessary as otherwise an intruder could easily circumvent the inhibiting nature of the combusting coating by simply extinguishing the coating and thereby gaining access to the coated object.

A general class of particularly effective combustible coatings according to the invention comprises a source of fuel and a source of oxygen in sufficient amounts that the coating is non-extinguishable. Presently preferred combustible coatings according to the invention comprise a three component coating of an oxidizer, a fuel metal, and a binder which also serves as a source of fuel. Suitable oxidizers include ammonium and alkali metal nitrates and perchlorates, such as ammonium nitrate ($NH_4NO_3$), potassium nitrate ($KNO_3$), sodium nitrate ($NaNO_3$), ammonium perchlorate ($NH_4ClO_4$) and potassium perchlorate ($KClO_4$). Suitable metals include one or more of aluminum, iron, lithium, beryllium, boron and magnesium, preferably in finely divided particulates, chopped foil or other easily combustible form, and alloys of such metals. Preferred metals are those, such as magnesium, which release the greatest amount of heat upon combustion. Binders which can serve as a fuel include carbonaceous materials such as asphalts, rubbers and natural and synthetic polymers, particularly inexpensive and lightweight polymers such as polystyrenes, polybutadienes, polyamides, polyesters, polysulfides and polyurethanes. The binder also provides a convenient vehicle for adhering the coating to an object or other desired substrate.

The relative proportions of oxidizer, metal and binder in the presently preferred coating compositions may vary considerably while still enabling the coating to fall within the framework of the above criteria. It has been generally found that the oxidizer should comprise the major amount of the coating composition, that is, the largest single constituent, whereas the metal and binder components should comprise minor amounts of the composition, that is, amounts less than the oxidizer, generallY in relatively equal amounts. For example, compositions of about 40–80 weight percent oxidizer, preferably 40–70 weight percent, about 5–25 weight percent metal fuel, and the remainder fuel binder, have been found to provide satisfactory combustible coatings for the purposes of the present invention. Varying the relative amounts of the three components enables the ignition temperature, burn rate and flame temperature of the coating to be varied.

In addition to the above components, the combustible coatings may include additional ingredients, particularly those common to solid propellant compositions. Such additional ingredients may include curing agents, fillers, bonding agents, stabilizers, surface active agents and the like.

In another preferred embodiment of the present invention, the combustible coating is incorporated in a honey-combed cell-like structure made of, for example, a metal or a polymeric material. Suitable honeycomb cell wall materials include imperforated and perforated aluminum, copper, fiberglass, steel, paper and polymers such as polypropylene, polyethylene, polystyrene and polycarbonate. Perforated honeycomb structures may have a plurality of minute orifices in the cell walls which assist in the migration of gases and thus promote flame propagation between cells. The cell dimensions in terms of height and distance across each cell can vary considerably. Honeycombed or cell-like structures of this nature may be adhered to a surface of the structure to be protected by conventional bonding techniques, or may be utilized, for example, as a layer in a laminar structure. Thus, a honeycomb including the combustible coating material of the present invention may be placed between two metal plates to form an intrusion resistant barrier structure. As utilized herein, the term combustible coating is understood to include such embodiments.

With such a composite combustible coating structure, adjacent cells are somewhat isolated from each other and thus combustion proceeds progressively from one cell to another in a controlled rate of combustion. In addition, the honeycomb structure for the combustible coating helps prevent the coating from separating from the object to which it is adhered when subjected to large forces such as those encountered upon impact by a linear shaped charge.

As a general proposition, the height of the flame produced by the combustible coating is dependent on the thickness of the coating. For example, a coating comprising of about 60 weight percent ammonium perchlorate, about 20 weight percent magnesium and about 20 weight percent polyurethane having a thickness of about one half inch, is capable of producing a flame of four to five feet in height. In most applications, a flame of this magnitude is sufficient to deter a would-be intruder and thus provide an effective delay barrier.

The compositions forming the combustible coatings of the invention can be prepared in a variety of manners. In some instances, a simple mixture of the components may suffice. In others, it may be appropriate to mix the oxidizer and metal with a fuel binder precursor such as a monomer or prepolymer and then polymerize or cure the precursor. The binder can also be mixed with a suitable solvent or the like, with the solvent driven off by heat or vacuum. In preparing the coating compositions, it may be economical to formulate them directly on the object to be protected. It is however within the scope of the invention to prepare the coatings as self-supporting bodies either by themselves or with the aid of a suitable substrate and thereafter securely affix the completed body encompassing the coating to the object to be protected.

One example of a preferred construction for the combustible coatings of the invention is shown in cross-section in the attached drawing. In this presently preferred embodiment, barrier 10 is secured to aluminum substrate 12, the coating comprising a water resistant layer 14, containing about 80 weight percent magnesium and about 20 weight percent polyurethane, and an overlying combustible layer 16 of about 60 weight percent ammonium perchlorate, about 20 weight percent polyurethane and about 20 weight percent magnesium. Layers 14 and 16 are encased in a water resistant layer 18 of polymeric material such as polyurethane which may optionaly be loaded with fillers such as glass and the like, layer 18 tending to slow the rate of combustion of barrier 10 and hence lessening the chance for an explosive-type combustion, and also helping provide an appropriate burn rate. The thickness, as well as the composition, of both the water resistant layer 14 and the polymer layer 18 are important in assuring the desired burn rate ant the reistance to quenching of the combustion. These layers should be at least about one-fourth inch thick, up to about one-half inch thick. Greater thicknesses may be utilized, subject to weight and cost considerations.

A structure as set forth in the preferred embodiment was subjected to testing to determine its DOT Explosive Class Rating, at the Bureau of Explosives. The combustible layer of the present invention was classified as a "Flammable Solid," in contrast to conventional solid propellants, which are "Class B" explosives.

As was mentioned previously, the combustible coatings as disclosed herein are suitable for application to a wide variety of objects to provide a delay barrier to help maintain the security of the object and/or its contents. Particular objects contemplated for being protected include structures, equipment, installations, buildings, vehicles, safes, and vaults. More specific applications include electrical equipment such as computers and related hardware, weapon systems, and protected buildings such as military and defense installations and commercial facilities, particularly those buildings subject to terrorist attacks, such as power plants, arsenals, and other weapons depositories. It should be recognized that the above examples are merely illustrative of the broad applications of the invention and many others will be evident to those of skill in the art.

The following examples illustrate specific compositions for the combustible coatings in accordance with the present invention. It should be understood that the examples are given for the purpose of illustration and do not limit the invention as has been described. In the examples, all parts and percentages are by weight unless otherwise specified.

EXAMPLE 1

Various styrene-based compositions for combustible coatings according to the invention were prepared and then combusted to determine the ignition temperature and burn or flame temperature. The samples were prepared by mixing oxidizer and particulate metal with uncured styrene, depositing the mixture on an aluminum plate and then polymerizing the styrene in an oven maintained at about 700° C. over a 24 hour period. After cooling, the samples were ignited by an electric igniter and the flame temperature measured by a thermocouple. The results of the ignition and burn temperature tests are set forth in the following Table I along with the particular compositions for the coatings:

TABLE I

| Sample Composition | Ignition Temperature | Burn Temperature |
|---|---|---|
| 40% $NH_4NO_3$<br>40% Styrene<br>20% Al | 390° C. | 500–550° C. |
| 70% $NH_4NO_3$<br>20% Styrene<br>10% Mg | 390° C. | 300–400° C. |
| 60% $NH_4NO_3$<br>30% Styrene<br>10% Mg | (1) 270° C.<br>(2) 330° C. | 400–450° C. |
| 60% $NH_4NO_3$<br>30% Styrene*<br>10% Mg | 300° C. | 400–450° C. |
| 50% $NH_4NO_3$<br>40% Styrene<br>10% Mg | 370° C. | 400° C. |
| 50% $NH_4NO_3$<br>40% Styrene*<br>10% Mg | 390° C. | 500–550° C. |
| 50% $NH_4NO_3$<br>30% Styrene*<br>20% Mg | 335° C. | 300–350° C. |
| 50% $NaClO_4$<br>40% Styrene<br>10% Al | 400° C. | 300° C. |
| 50% $NaClO_4$<br>40% Styrene*<br>10% Al | 400° C. | 350–400° C. |
| 50% $NaClO_4$<br>30% Styrene*<br>20% Al | 400° C. | |
| 40% $NaClO_4$<br>40% Styrene<br>20% Al | 400° C. | 350–550° C. |
| 70% $NaClO_4$<br>20% Styrene<br>10% Mg | 390° C. | 400° C. |
| 60% $NaClO_4$<br>30% Styrene<br>10% Mg | 400° C. | 350–400° C. |
| 50% $NaClO_4$<br>40% Styrene<br>10% Mg | 400° C. | 400–450° C. |

*partially polymerized.

EXAMPLE II

One of the coating compositions of Example I was then tested for its ability to ignite or not ignite under various conditions that might be encountered in providing a delay barrier against unauthorized entry into an object. The composition used was 60 percent ammonium nitrate, 20 percent magnesium and 20 percent polystyrene, prepared as in Example I. Two samples were prepared, one a ¼ inch thick coating on a foot square piece of aluminum, and the other a similar coating on a steel substrate. Neither of the coatings ignited when pierced by a rifle bullet. Penetration by an electric saw ignited the coating and although the fire was violent, the coating burned for only a few seconds. A linear shape charge blew away most of the coating material, but what remained burned violently. It was noted that the compositions tended to be somewhat brittle, did not have particularly good adherence to the substrate and tended to burn rapidly.

EXAMPLE III

Various polyurethane-based compositions for combustible coatings according to the invention were prepared and then combusted to determine their ignition temperature. The results are set forth in the following Table II, along with the particular compositions for the coatings:

TABLE II

| | Sample Composition (wt. %) Urethane | Mg | Ignition Temperature |
|---|---|---|---|
| $NH_4ClO_4$ | | | |
| 60 | 20 | 20 | 370° C. |
| 60 | 20 | 20 | 350° C. |
| $NH_4NO_3$ | | | |
| 50 | 30 | 20 | 400° C. |
| 60 | 20[1] | 20 | 370° C. |
| 60 | 30 | 10 | 400° C. slow igniting |
| 60 | 20[2] | 20 | 385° C. |
| 60 | 20 | 20 | 385° C. |
| 60 | 30 | 10(Al) | 320° C. |
| 60 | 25 | 15 | 350° C. |
| 60 | 25 | 15(Al) | 350° C. |

Notes:
[1]85% polyurethane, 15% curing agent
[2]95% polyurethane, 5% curing agent As is apparent from the above, all samples tested had an ignition temperature in excess of 300° C., and thus all fall within the first criteria for the combustible coatings of the invention.

EXAMPLE IV

One of the samples of Example III was then tested as to its potential for ignition after being subjected to a variety of conditions and events. The composition tested contained about 60 percent ammonium perchlorate, about 20 percent polyurethane and about 20 percent magnesium.

The coating was found not to ignite after ballistic tests using NATO 7.62 mm M-80 ball rounds. The burning rate after ignition by a linear shaped charge or an electric saw was about two inches per minute. The combustion started by the latter two means could not be extinguished by either a Class D type fire extinguisher or by water flowing at 5.0 gpm/sq. inch, or even greater, and ignition occurred even if the combustible coating sample was maintained at a temperature as low as −50° F.

One sample of the combustible coatings was subjected to platter charge attack, and in seconds a hole was created in the barrier by. the platter charge. Combustion was immediately initiated and was sustained until the entire coating was consumed.

EXAMPLE V

A coating composition similar to that of Example IV was prepared and formed into four samples of varying length. Each sample was coated with a ¼ inch layer of polyurethane and then ignited to determine the burn rate for each sample. The results are set forth in the following table:

TABLE III

| Sample No. | Tray Length (inches) | Burn Time (sec.) |
|---|---|---|
| 1 | 2 | 61 |
| 2 | 4 | 115 |
| 3 | 6 | 105 |
| 4 | 12 | 183 |

When this data are presented graphically, it indicates that this particular embodiment of the invention has an approximate burn rate of about 2–4 inches per minute, well within the criteria set forth previously.

EXAMPLE VI

A composition comprising about 60 percent ammonium perchlorate, 20 percent polyurethane, and 20 percent magnesium was prepared, coated on an aluminum substrate, and encapsulated in a one inch thermal insulating layer of Fiberfrax. This structure was tested to evaluate rate of combustion and confinement of the combustion. It was found that use of a thermal barrier of this type enables one to control spread of the combustion, permitting use of the barrier layer in confined areas or in proximity to other flammable materials.

In summary, the combustible coatings of the present invention can provide an effective delay barrier against entry into an object by an intruder. The coatings are relatively safe for transportation and for use on various objects such as buildings and equipment, have a relatively long shelf life, and can be made from relatively inexpensive materials.

While there has been shown and described what are considered to be preferred embodiments of the present invention, it will be obvious to those skilled in the art that various changes and modifications may be made therein without departing from the invention as defined in the appended claims.

What is claimed is:

1. A combustible coating for providing a delay barrier to intrusion into an object, the coating comprising a combustible layer containing a substantially homogeneous mixture of fuel and oxidizer, the coating being ignitable at a temperature in excess of about 300° C., resistant to the effects of common fire extinguishing materials during combustion, and capable of sustaining combustion for at least five minutes with a burn rate of from about 1 to about 4 inches per minute, and a burn temperature of less than about 550° C.

2. A combustible coating in accordance with claim 1, wherein the coating includes an oxidizer, a metal fuel in particulate form, and a carbonaceous binder.

3. A combustible coating in accordance with claim 2 wherein the combustible layer is from about 0.25 to about 0.5 inches thick.

4. A combustible cosating in accordance with claim 3, wherein the oxidizer is selected from one or more of the group consisting of ammonium nitrate, potassium nitrate, sodium nitrate, ammonium perchlorate and potassium perchlorate.

5. A combustible coating in accordance with claim 4, wherein the carbonaceous binder contains a polymer.

6. A combustible coating in accordance with claim 5, wherein the polymer is selected from the group consisting of polyurethane and polystyrene.

7. A combustible coating in accordance with claim 6, wherein the metal is selected from the group consisting of aluminum, magnesium, lithium, beryllium, boron, iron, and mixtures thereof.

8. A combustible coating in accordance with claim 2, wherein the metal is slected from the group consisting of aluminum, magnesium, lithium, beryllium, boron, iron, and mixtures thereof.

9. A combustible coating in accordance with claim 8, wherein the carbonaceous binder includes a polymer selected from the group consisting of polyurethane and polystyrene and the oxidizer is selected from the group consisting of ammonium nitrate, potassium nitrite, ammonium perchlorate, potassium perchlorate, and mixtures thereof.

10. A combustible coating in accordance with claim 9, wherein the coating comprises from about 40 to about 80 weight percent oxidizer, about 10 to 20 weight percent metal, the remainder essentially polymer.

11. A combination comprising an object and a combustible coating over at least a portion of the object for providing a delay barrier to intrusion into an object, the coating comprising a combustible layer containing a substantially homogeneous mixture of fuel, oxidizer, and binder, the coating being ignitable at a temperature in excess of about 300° C., resistant to the effects of common fire extinguishing material, and capable of sustaining combustion with a burn rate of from about 1 to about 4 inches per minute, and a burn temperature of less than about 550° C.

12. A combination in accordance with claim 11, wherein the fuel includes a metal in particulate form and the binder is a carbonaceous binder.

13. A combination in accordance with claim 12, wherein the combustible layer is from about 0.25 to about 0.5 inches thick.

14. A combination in accordance with claim 13, wherein the oxidizer is selected from the group consisting of ammonium nitrate, potassium nitrate, sodium nitrate, ammonium perchlorate, potassium perchlorate, and mixture thereof.

15. A combination in accordance with claim 14, wherein the carbonaceous binder contains a polymer.

16. A combination in accordance with claim 15, wherein the polymer is selected from the group consisting of polyurethane and polystyrene.

17. A combination in accordance with claim 12, wherein the metal is selected from the group consisting of aluminum, magnesium and iron.

18. A combination in accordance with claim 11, wherein the object is a building.

19. A combination in accordance with claim 11, wherein the object is a vault.

20. A combination in accordance with claim 11, wherein the coating is encased in polymeric material.

21. A combustible coating in accordance with claim 1, wherein the combustible layer is encased in polymeric material.

22. A combustible coating in accordance with claim 1, wherein the coating is secured to a metal substrate.

23. A combination in accordance with claim 13, wherein the coating is secured to a metal substrate.

* * * * *